US009121309B2

(12) United States Patent
Geiger

(10) Patent No.: US 9,121,309 B2
(45) Date of Patent: Sep. 1, 2015

(54) GAS TURBINE AND METHOD OF OPERATING A GAS TURBINE

(75) Inventor: Peter Geiger, Munich (DE)

(73) Assignee: MTU Aero Engines GmbH, Munich (DE)

( * ) Notice: Subject to any disclaimer, the term of this patent is extended or adjusted under 35 U.S.C. 154(b) by 1426 days.

(21) Appl. No.: 12/308,211

(22) PCT Filed: Jun. 10, 2006

(86) PCT No.: PCT/DE2006/000996

§ 371 (c)(1),
(2), (4) Date: Dec. 9, 2008

(87) PCT Pub. No.: WO2007/140730

PCT Pub. Date: Dec. 13, 2007

(65) Prior Publication Data

US 2009/0301053 A1 Dec. 10, 2009

(51) Int. Cl.

| | |
|---|---|
| ***F02C 7/12*** | (2006.01) |
| ***F01D 25/36*** | (2006.01) |
| ***F01D 21/06*** | (2006.01) |
| ***F01D 21/08*** | (2006.01) |

(52) U.S. Cl.
CPC ..... *F01D 25/36* (2013.01); *F01D 21/06* (2013.01); *F01D 21/08* (2013.01)

(58) Field of Classification Search
CPC ..... F01K 3/02; F01K 3/22; F01K 7/24; F01D 21/06
USPC ..... 60/788, 786, 778, 779, 39.091, 802
See application file for complete search history.

(56) References Cited

U.S. PATENT DOCUMENTS

| | | | | |
|---|---|---|---|---|
| 3,793,905 | A * | 2/1974 | Black et al. | 74/661 |
| 4,309,870 | A * | 1/1982 | Guest et al. | 60/39.08 |
| 4,452,037 | A * | 6/1984 | Waddington et al. | 60/39.08 |
| 4,733,529 | A | 3/1988 | Nelson et al. | 60/39.091 |
| 4,854,120 | A * | 8/1989 | Nelson et al. | 60/772 |
| 6,031,294 | A * | 2/2000 | Geis et al. | 290/52 |
| 6,125,624 | A * | 10/2000 | Prociw | 60/39.094 |
| 6,237,322 | B1 * | 5/2001 | Rago | 60/39.08 |
| 6,891,282 | B2 * | 5/2005 | Gupta et al. | 290/52 |
| 7,188,475 | B2 * | 3/2007 | McGinley et al. | 60/726 |
| 2005/0150232 | A1 * | 7/2005 | Dittmann et al. | 60/782 |

FOREIGN PATENT DOCUMENTS

| | | |
|---|---|---|
| CH | 349625 | 12/1960 |
| DE | 524329 | 4/1931 |

OTHER PUBLICATIONS

English Translation of International Search Report of PCT/DE2006/000996.

* cited by examiner

*Primary Examiner* — Phutthiwat Wongwian
*Assistant Examiner* — Vikansha Dwivedi
(74) *Attorney, Agent, or Firm* — Davidson, Davidson & Kappel, LLC

(57) ABSTRACT

A gas turbine including at least one compressor, one combustion chamber, and at least one turbine including at least one rotor and at least one generator coupled to the at least one rotor is provided. The at least one turbine is coupled to the at least one compressor. Once the gas turbine is shut down, the at least one generator can be used as a motor in order to drive the at least one rotor for a predetermined time period following shutdown of the gas turbine and thereby effect a uniform cooling of the rotor. A method of operating a gas turbine is also provided.

7 Claims, 1 Drawing Sheet

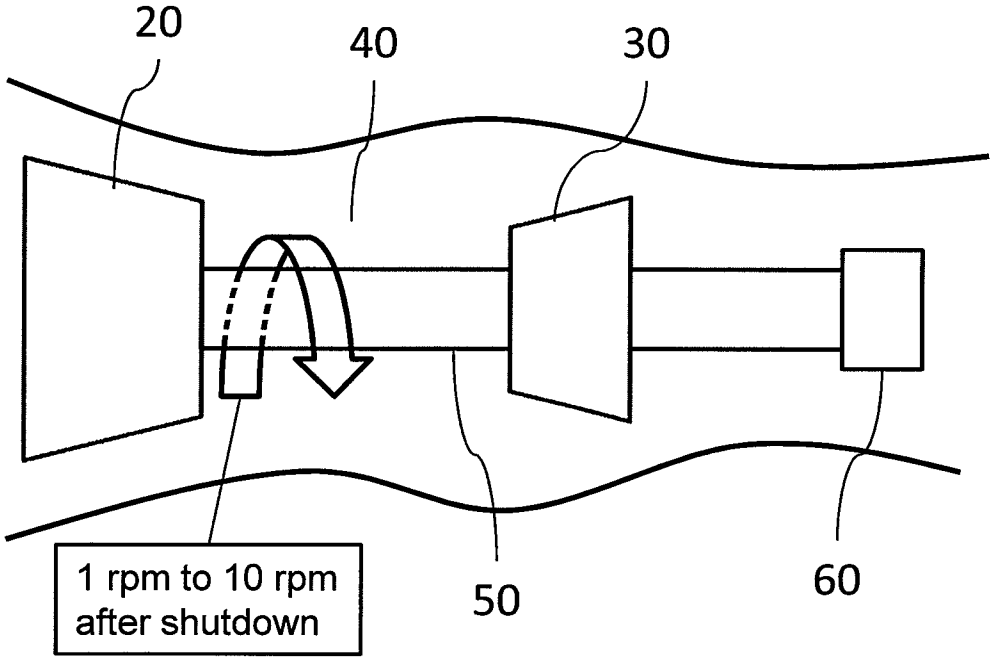
20
40
30
60
50
1 rpm to 10 rpm
after shutdown

GAS TURBINE AND METHOD OF OPERATING A GAS TURBINE

This is a national phase of International Application No. PCT/DE2006/000996, filed Jun. 10, 2006, which claims priority to this International Application.

The present invention relates to a gas turbine and a method for operating a gas turbine, in particular a gas turbine including at least one compressor, one combustion chamber and at least one turbine.

BACKGROUND

Gas turbines, such as aircraft engines, for example, have a plurality of assemblies, thus, for example, at least one compressor, one combustion chamber, as well as at least one turbine. During operation of the gas turbine, the rotor-side components of the or each turbine are exposed to high temperatures. Under the related art, the rotor-side components of the or each turbine cool down at standstill when the gas turbine is shut down or subsequently thereto. As the rotor-side components of a turbine at standstill cool down, convection-induced differences in temperature occur at a bottom and a top side. These temperature differences at the top and bottom side of the rotor can cause warpage of the same, resulting in what is commonly known as rotor bow. In this context, the warpage of the rotor can be so significant that rotor-side blades on a housing of the turbine, as well as stator-side guide vanes at a hub of the rotor come into contact. In such a case, the gas turbine can only be restarted when the rotor bow disappears again after a lengthy cooling period. Otherwise, restarting the gas turbine would damage the same.

Against this background, an object of the present invention is to devise a novel gas turbine, as well as a novel method for operating a gas turbine.

SUMMARY OF THE INVENTION

A gas turbine including at least one compressor, one combustion chamber, at least one turbine including at least one rotor and at least one electric generator coupled to the at least one rotor is provided. The at least one turbine is coupled to the at least one compressor. Once the gas turbine is shut down, the at least one generator can be used as a motor in order to drive the at least one rotor for a predetermined time period following shutdown of the gas turbine and thereby effect a uniform cooling of the at least one rotor. A method of operating a gas turbine is also provided.

In accordance with the present invention, once the gas turbine is shut down, the or each generator may be used as a motor in order to drive a rotor of the particular turbine for a predetermined time period after the gas turbine is shut down and thereby effect a uniform cooling of the rotor.

Once the gas turbine is shut down, the present invention provides that the rotor of the particular turbine be driven for a predetermined time period. This makes it possible to effect or establish a uniform cooling of the rotor of the particular turbine. Since the rotor of the particular turbine is driven rotationally for a predetermined time period following shutdown of the gas turbine, convection-induced differences in temperature at the bottom side, as well as the top side of the rotor are avoided, thereby preventing the formation of a rotor warpage, i.e., a rotor bow. An early restarting of a gas turbine following shutdown of the same is made possible by the present invention.

Following shutdown of the gas turbine, the or each generator preferably drives the rotor of the particular turbine at a speed on the order of between 0.1 rpm to 10 rpm, particularly on the order of between 0.2 rpm to 5 rpm.

One advantageous embodiment of the present invention additionally provides for effecting or establishing an oil circulation following the shutdown in order to thereby prevent an oil coking following shutdown of the gas turbine.

A method for operating a gas turbine including at least one compressor, one combustion chamber, and at least one turbine is provided. The method includes the steps of shutting down the gas turbine; and once the gas turbine is shut down, driving at least one rotor of the at least one turbine for a predetermined time period in order to thereby effect a uniform cooling of the rotor.

BRIEF DESCRIPTION OF THE DRAWINGS

FIG. 1 shows a schematic view of a gas turbine.

DETAILED DESCRIPTION

Preferred embodiments of the present invention are derived from the dependent claims and from the following description, without being limited thereto.

Gas turbines, as shown schematically in FIG. 1, have a plurality of assemblies, namely at least one compressor 20, one combustion chamber 40, as well as at least one turbine 30. Thus, gas turbines having two compressors and two turbines are known from the related art. It is a question then in this case of a low-pressure compressor, a high-pressure compressor, a high-pressure turbine, as well as of a low-pressure turbine. Moreover, gas turbines having three compressors, as well as three turbines are known, it being a question then in this case of a low-pressure compressor, a medium-pressure compressor, a high-pressure compressor, a high-pressure turbine, a medium-pressure turbine, as well as of a low-pressure turbine.

In each case, a compressor is coupled to a turbine via a shaft. In the case of gas turbines having two compressors and two turbines, the high-pressure turbine is coupled to the high-pressure compressor and the low-pressure turbine to the low-pressure compressor, in each case via a shaft. In addition, in the case of a gas turbine having three compressors and three turbines, the medium-pressure turbine is coupled to the medium-pressure compressor via a shaft.

Gas turbines having generators are already known from the related art, the generators being used to generate electrical energy. Thus, for example, the low-pressure turbine may have a generator 60 shown schematically assigned thereto, which, during operation of the gas turbine, draws power from the low-pressure turbine and generates electrical energy therefrom. The electrical energy produced by the generator is then used for operating add-on assemblies of the gas turbine, respectively for operating other electrical devices.

Along the lines of the present invention, once the gas turbine is shut down, it is provided that the rotor 50 of the or each turbine be driven rotationally for a predetermined time period in order to thereby effect a uniform cooling of the rotor-side assemblies of the respective turbine rotor. Following shutdown of the gas turbine, the present invention provides in this context that the or each generator, whose purpose is to generate electrical energy during operation of the gas turbine, be used as a motor and, accordingly, be operated in motor operation. In motor operation, the or each generator then converts electrical energy into mechanical energy to drive the particular turbine rotor, the particular turbine rotor being driven at a relatively low speed. In this context, the present invention provides that the particular turbine rotor be driven at a speed on the order of between 0.1 rpm to 10 rpm as shown in FIG. 1, preferably on the order of 0.2 rpm to 5 rpm.

For example, if the low-pressure turbine of a gas turbine has a generator assigned thereto to generate electrical energy, then, in accordance with the present invention, following shutdown of the gas turbine, the generator of the low-pressure turbine is used in motor operation in order to drive, respectively rotate the rotor of the low-pressure turbine, respectively the rotor-side components of the low-pressure turbine, for a predetermined time period. This makes it possible to effect a uniform cooling of the rotor-side assemblies of the low-pressure turbine. Different temperatures at a top side, as well as a bottom side of the rotor-side assemblies of the low-pressure turbine may be avoided. Following shutdown of the gas turbine, it is likewise possible for the rotor of a medium-pressure turbine, as well as of a high-pressure turbine, to be driven by a generator assigned to the particular turbine for a predetermined time period.

Following shutdown of the gas turbine, the present invention also provides for an oil circulation to be additionally established in the lubrication system of the particular turbine in order to thereby prevent an oil coking following shutdown of the gas turbine. The oil circulation may be effected, for example, in that following shutdown of the gas turbine, the or each generator also drives an oil pump in order to thereby bring about the oil circulation. Alternatively, the turbine rotor driven by the generator may effect an oil circulation in that, for example, the ribs assigned to the rotor in the area of a bearing sump of a rotor bearing bring about a pump effect and thereby induce an oil circulation. In any case, however, an oil circulation effected following shutdown of the gas turbine prevents the oil from overheating, thereby reducing the danger of an oil coking.

During maintenance or inspection of a gas turbine, the or each generator may likewise be used in motor operation in order to thereby rotate the rotor-side assemblies of the respective turbine for purposes of maintenance or inspection. In this manner, the inspection of rotor-side blades may be facilitated, for example, during what is generally referred to as a boroscope inspection.

The invention claimed is:

1. A method for operating an aircraft engine including at least one compressor, one combustion chamber, and at least one turbine coupled to the at least one compressor via a shaft, comprising the steps of:

generating electricity during operation of the aircraft engine in a generator;

shutting down the aircraft engine; and once the aircraft engine is shut down, driving a low pressure turbine the at least one turbine for a predetermined time period in order to thereby effect a uniform cooling of the rotor, the generator switching to a motor operation and driving the at least one rotor at a speed of between 0.1 rpm and 10 rpm during the predetermined time period, to reduce a temperature of the rotor before restarting the engine.

2. The method as recited in claim 1 wherein, following shutdown of the aircraft engine, the at least one rotor is driven at a speed on the order of between 0.2 rpm to 5 rpm.

3. The method as recited in claim 1 wherein, following the shutdown, an oil circulation is effected or established, in order to thereby prevent an oil coking following shutdown of the aircraft engine.

4. The method as recited in claim 3 wherein, following shutdown of the aircraft engine the rotating rotor effects the oil circulation, thereby preventing the oil coking following shutdown of the aircraft engine.

5. The method as recited in claim 3 wherein, following shutdown of the aircraft engine, the step of driving includes driving at least one oil pump with the generator in order to thereby effect the oil circulation and thus prevent an oil coking following shutdown of the aircraft engine.

6. The method as recited in claim 1 wherein the at least one compressor includes a low-pressure compressor, and the at least one turbine includes the low pressure turbine, the generator being driven by the low-pressure turbine.

7. The method as recited in claim 1 wherein the generator is driven by turbine.

* * * * *